US010786014B2

(12) United States Patent
Ladner

(10) Patent No.: US 10,786,014 B2
(45) Date of Patent: Sep. 29, 2020

(54) THERAPEUTIC INFANT SWADDLING WRAP

(71) Applicant: Shonjrell Ladner, Knoxville, TN (US)

(72) Inventor: Shonjrell Ladner, Knoxville, TN (US)

( * ) Notice: Subject to any disclaimer, the term of this patent is extended or adjusted under 35 U.S.C. 154(b) by 718 days.

(21) Appl. No.: 15/582,075

(22) Filed: Apr. 28, 2017

(65) Prior Publication Data

US 2018/0310637 A1 Nov. 1, 2018

(51) Int. Cl.

| | |
|---|---|
| ***A41B 13/06*** | (2006.01) |
| ***A47G 9/08*** | (2006.01) |
| ***A47G 9/06*** | (2006.01) |
| ***A47G 9/02*** | (2006.01) |

(52) U.S. Cl.

CPC ..... *A41B 13/06* (2013.01); *A47G 9/023* (2013.01); *A47G 9/064* (2013.01); *A47G 9/08* (2013.01); *A47G 9/083* (2013.01); *A47G 9/086* (2013.01)

(58) Field of Classification Search

CPC ..... A47G 9/08; A47G 9/083; A47G 9/086; A47G 9/023; A47G 9/0223; A47G 9/0215

See application file for complete search history.

(56) References Cited

U.S. PATENT DOCUMENTS 2,227,751 A * 1/1941 Idelman ..... A41B 13/06 2/69.5
2,324,665 A * 7/1943 Ayres ..... A41B 13/06 5/413 R
5,129,406 A * 7/1992 Magnusen ..... A41B 13/06 128/845
5,692,257 A * 12/1997 Albertieri ..... A41B 13/06 5/494
5,722,094 A 3/1998 Ruefer
5,950,261 A * 9/1999 Hay ..... A41B 13/06 2/69
6,009,576 A * 1/2000 Gramme ..... A41B 13/06 2/69
6,142,963 A 11/2000 Black et al.
6,341,397 B1 * 1/2002 Kliegl ..... A41B 13/06 2/69.5
6,868,566 B2 3/2005 Gatten
7,076,819 B2 7/2006 Trani et al.
7,181,789 B2 2/2007 Gatten
(Continued)

FOREIGN PATENT DOCUMENTS

EP 3053486 A1 8/2016

*Primary Examiner* — Peter M. Cuomo
*Assistant Examiner* — Ifeolu A Adeboyejo
(74) *Attorney, Agent, or Firm* — Pitts & Lake, P.C.

(57) ABSTRACT

An infant wrap for swaddling an infant, including a base layer with a front surface having a rough texture and a rear surface having a soft texture, a pocket forming layer attached to the base layer to form a pocket with the base layer, the pocket forming layer having the rough texture at least on an inner surface facing the base layer, and configured to be detachably fastened to the base layer on at least one side of the pocket forming layer, a wire port formed proximate a bottom of the pocket forming layer to pass monitor wires therethrough, and a flap extending from one side of the base layer and having a same textured and soft surface arrangement as the base layer, and configured to fold over the pocket forming layer such that the surface of the flap having the rough texture faces inwardly toward the pocket forming layer.

16 Claims, 5 Drawing Sheets

(56) References Cited

U.S. PATENT DOCUMENTS 7,254,849 B1* 8/2007 Fiebrich ..... A41B 13/06 2/69.5
7,346,949 B2 3/2008 Kamrin-Balfour
7,850,595 B2 12/2010 White
7,997,465 B2 8/2011 Garofalo et al.
8,032,958 B2* 10/2011 Pieta ..... A41B 13/06 2/69.5
8,607,364 B2 12/2013 Barski
8,671,486 B1* 3/2014 Paperno ..... A41B 13/06 5/655
8,898,833 B2 12/2014 Coates
9,237,771 B2 1/2016 Paperno
9,332,791 B1* 5/2016 Bush ..... A41D 11/00
9,572,376 B2 2/2017 Gangan et al.
2003/0079270 A1* 5/2003 Bailey ..... A41B 13/06 2/69.5
2004/0216230 A1* 11/2004 Blackburn ..... A41B 13/06 5/482
2006/0236441 A1* 10/2006 Johnson ..... A41B 13/06 2/69.5
2007/0056098 A1 3/2007 Schmid et al.
2007/0074348 A1 4/2007 Carlton
2007/0157392 A1* 7/2007 Ragen ..... A41B 13/06 5/655
2009/0249526 A1 10/2009 Carangelo
2010/0071709 A1* 3/2010 Grissom ..... A41B 13/06 128/870
2010/0192304 A1 8/2010 Kovalyak
2010/0212060 A1* 8/2010 Whitcomb ..... A41B 13/06 2/75
2010/0257653 A1* 10/2010 Pitts ..... A41B 13/06 2/69.5
2010/0275373 A1* 11/2010 Kaplan ..... A47D 15/008 5/494
2011/0083276 A1* 4/2011 Pieta ..... A41B 13/06 5/655
2011/0197365 A1* 8/2011 Wadia ..... A47D 13/02 5/655
2011/0277210 A1* 11/2011 Hardesty ..... A41B 13/06 2/69.5
2012/0110716 A1* 5/2012 Christensen ..... A41B 13/06 2/69.5
2012/0284922 A1* 11/2012 Gangan ..... A41B 13/06 5/494
2012/0311762 A1* 12/2012 Aiken ..... A41B 13/06 2/69.5
2013/0333113 A1 12/2013 Gotel et al.
2014/0020177 A1* 1/2014 Coates ..... A41B 13/06 5/494
2014/0033430 A1* 2/2014 Daugherty ..... A41B 13/06 5/494
2014/0068834 A1* 3/2014 Skinner ..... A41B 13/06 2/69.5
2014/0150159 A1* 6/2014 Alluna ..... A47D 13/02 2/69.5
2014/0238413 A1 8/2014 Ottinger
2014/0298587 A1* 10/2014 Sedivy ..... A41B 13/06 5/655
2015/0038887 A1 2/2015 Piccirillo
2015/0128350 A1* 5/2015 Paperno ..... A47G 9/083 5/655
2015/0237920 A1* 8/2015 Pruitt ..... A41B 13/06 2/69.5
2015/0237934 A1* 8/2015 Kirkland ..... A41D 13/1272 2/455
2015/0342263 A1* 12/2015 Taylor ..... A41B 13/06 2/69.5
2015/0342264 A1* 12/2015 O'Donnell ..... A47D 13/083 5/655
2016/0037827 A1* 2/2016 Rogers ..... A41B 13/06 5/655
2016/0174619 A1* 6/2016 Waters ..... A41B 13/065 2/69.5
2016/0278443 A1 9/2016 Clements et al.
2016/0295928 A1* 10/2016 Bopanna ..... A41B 13/06
2016/0360799 A1 12/2016 Goldstein et al.
2017/0055592 A1* 3/2017 Stephan ..... A41B 13/06

* cited by examiner

THERAPEUTIC INFANT SWADDLING WRAP

CROSS-REFERENCE TO RELATED APPLICATIONS

Not applicable.

FIELD OF INVENTION

The present general inventive concept relates to an infant swaddling wrap, and, more particularly, a therapeutic infant swaddling wrap for use in a neonatal intensive care unit.

BACKGROUND

Wrapping an infant in swaddling clothes, which restricts motor activity and mimic's the secure feeling of the womb, has been practiced for generations, and the many benefits of swaddling are well known. The security felt by the infant in swaddling garments aids in the length of time spent sleeping, as well as the level of sleep, and reduces and stabilizes the heart rate of the infant. The feel of swaddling garments is generally soothing to the infant, and may aid in reducing time spent crying. Swaddling garments may also be used to prevent a child from sleeping on his or her stomach, reducing the risk of sudden death syndrome. As such, various types of swaddling garments, involving various levels of complexity, have been used to provide these benefits to the infants, beginning at the newborn stage.

The otherwise simple concept of swaddling becomes much more contemplated in cases in which babies are born with neonatal withdrawal or neonatal abstinence syndrome (NAS), wherein babies are born with drug dependencies, both licit and illicit. In fact, the increasingly lucrative prescription drug business has led to a growing epidemic prescribed opiate drugs leading to babies being drug dependent at birth. The sudden cessation of the administration of these drugs that occurs upon birth can typically cause a variety of problems that requires suffering infants to be placed in a neonatal intensive care unit (NICU). The babies born with NAS suffer from many side effects such as sensitivity to light and sounds, tremors, upset stomach, acid reflux, sensitivity to soft material, and so on. As is the case with most babies, swaddling and cuddling is typically highly soothing, and eases the symptoms of their dependencies. However, while parents, and/or caretakers that often substitute for missing parents either temporarily or permanently, desperately want to comfort the infant during the withdrawal phase, many problems associated with the dependencies themselves make the act of swaddling and cuddling problematic. For example, a drug addicted baby's skin is often highly irritated by soft materials that may foster a cuddling activity. As another example, babies confined to the NICU are often attached to various types of medical monitors through a variety of wires and electrodes, which complicates the effective and secure application of a swaddling garment.

Therefore, there exists a need for a swaddling garment that is able to provide features that are especially valuable in overcoming the problems encountered with drug addicted babies confined to the NICU, and which will foster the desire and ability of caretakers wishing to give much needed comfort to these infants.

BRIEF SUMMARY

According to various example embodiments of the present general inventive concept, an infant wrap for swaddling an infant is provided that includes features to aid with or overcome various problems encountered in an NICU such as hyper-sensitive skin, complications caused by monitoring equipment, secure handling of undersized and underdeveloped infants, and so on.

Additional aspects and advantages of the present general inventive concept will be set forth in part in the description which follows, and, in part, will be obvious from the description, or may be learned by practice of the present general inventive concept.

The foregoing and/or other aspects and advantages of the present general inventive concept may be achieved by providing an infant wrap for swaddling an infant, including a base layer configured with a front surface having a rough texture and a rear surface having a soft texture relative to the rough texture, a pocket forming layer attached to the base layer and configured to form a pocket with the base layer, the pocket forming layer having the rough texture at least on an inner surface facing the base layer, and configured to be detachably fastened to the base layer on at least one side of the pocket forming layer, a wire port formed proximate a bottom of the pocket forming layer and configured such that monitor wires are able to pass therethrough, and a flap extending from one side of the base layer and having a same textured and soft surface arrangement as the base layer, and configured to fold over the pocket forming layer such that the surface of the flap having the rough texture faces inwardly toward the pocket forming layer.

The foregoing and/or other aspects and advantages of the present general inventive concept may also be achieved by providing an infant wrap for swaddling an infant, including a base layer configured to be positioned at least partially under an infant in a swaddling configuration, a padded head cushion extending from a top portion of the base layer and having a depressed portion on a front surface thereof, a body padding portion detachably fastened to the base layer and configured to have a substantially u-shaped head support roll at a top thereof configured to provide padded support proximate a top and sides of an infant's head, and a transverse leg support roll proximate a bottom thereof configured to provide padded support under an infant's legs, and at least one flap extending from one side of the base layer and configured to fold over and surround at least the body padding portion of the infant wrap, wherein the body padding portion is configured such that the head support roll extends from the top portion of the base layer to be freely received in the depressed portion of the head cushion.

The foregoing and/or other aspects and advantages of the present general inventive concept may also be achieved by providing an infant wrap for swaddling an infant, including a base layer configured with a front surface having a rough texture and a rear surface having a soft texture relative to the rough texture, a padded head cushion extending from a top portion of the base layer and having a depressed portion on a front surface thereof, a device compartment formed proximate a side of the head cushion, a body padding portion detachably fastened to the base layer and having the rough texture at least on a front surface and configured to have a substantially u-shaped head support roll at a top thereof configured to provide padded support proximate a top and sides of an infant's head, a transverse leg support roll proximate a bottom thereof configured to provide padded support under an infant's legs, a pliant portion between the head support roll and leg support roll to allow distance therebetween to be adjustable, and a body harness configured to secure an infant into the body padding portion, a pocket forming layer attached to the base layer and configured to form a pocket with the base layer that surrounds at least a portion of the body padding portion, the pocket forming layer having the rough texture at least on an inner surface facing the base layer, and configured to be detachably fastened to the base layer on at least one side of the pocket forming layer, a wire port formed proximate a bottom of the pocket forming layer and configured such that monitor wires are able to pass therethrough, a flap extending from one side of the base layer and having a same textured and soft surface arrangement as the base layer, and configured to fold over the pocket forming layer such that the surface of the flap having the rough texture faces inwardly toward the pocket forming layer, a pair of securing straps extending respectively from opposite sides of the base layer and configured to be wrapped over the flap in a folded arrangement to secure the infant wrap in a swaddling form, the securing straps being padded and formed in a substantially tubular shape, one or more bottom extensions extending from a bottom of the base layer and configured to be tucked under the folded arrangement of the securing straps such that a length of the infant wrap may be shortened to a desired length, wherein the body padding portion is configured such that the head support roll extends from the top portion of the base layer to be freely received in the depressed portion of the head cushion.

Other features and aspects may be apparent from the following detailed description, the drawings, and the claims.

BRIEF DESCRIPTION OF THE FIGURES

The following example embodiments are representative of example techniques and structures designed to carry out the objects of the present general inventive concept, but the present general inventive concept is not limited to these example embodiments. In the accompanying drawings and illustrations, the sizes and relative sizes, shapes, and qualities of lines, entities, and regions may be exaggerated for clarity. A wide variety of additional embodiments will be more readily understood and appreciated through the following detailed description of the example embodiments, with reference to the accompanying drawings in which.

DETAILED DESCRIPTION

Figure 1:
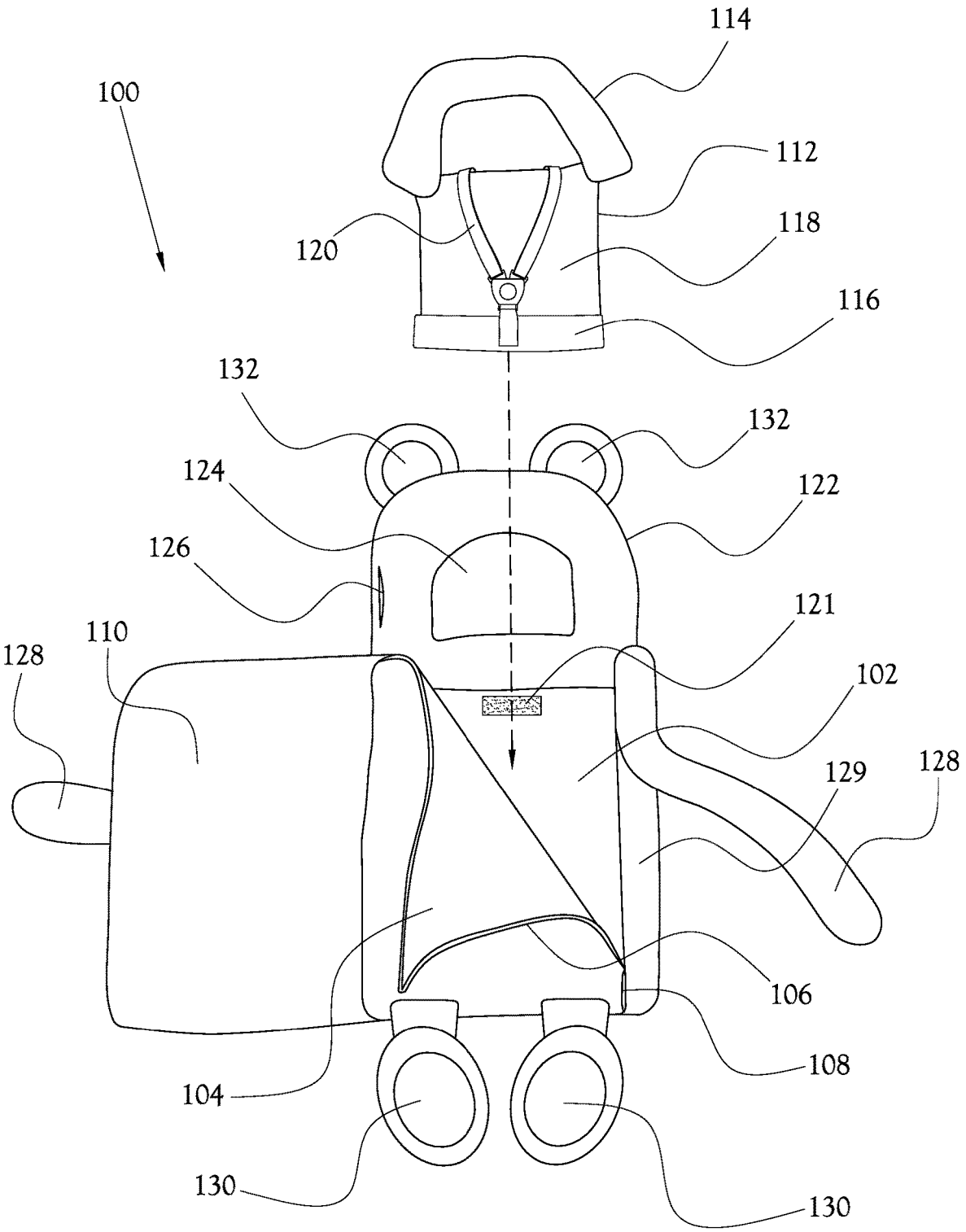
FIG. 1 illustrates a swaddling wrap according to an example embodiment of the present general inventive concept.

Reference will now be made to the example embodiments of the present general inventive concept, examples of which are illustrated in the accompanying drawings and illustrations. The example embodiments are described herein in order to explain the present general inventive concept by referring to the figures.

The following detailed description is provided to assist the reader in gaining a comprehensive understanding of the structures and fabrication techniques described herein. Accordingly, various changes, modification, and equivalents of the structures and fabrication techniques described herein will be suggested to those of ordinary skill in the art. The progression of fabrication operations described are merely examples, however, and the sequence type of operations is not limited to that set forth herein and may be changed as is known in the art, with the exception of operations necessarily occurring in a certain order. Also, description of well-known functions and constructions may be simplified and/or omitted for increased clarity and conciseness.

Note that spatially relative terms, such as "up," "down," "right," "left," "beneath," "below," "lower," "above," "upper" and the like, may be used herein for ease of description to describe one element or feature's relationship to another element(s) or feature(s) as illustrated in the figures. Spatially relative terms are intended to encompass different orientations of the device in use or operation in addition to the orientation depicted in the figures. For example, if the device in the figures is turned over or rotated, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

According to various example embodiments of the present general inventive concept, an infant wrap for swaddling an infant is provided that includes features to aid with or overcome various problems encountered in an NICU such as hyper-sensitive skin, complications caused by monitoring equipment, secure handling of undersized and underdeveloped infants, and so on. For example, many babies born with drug dependencies/addictions suffer from hyper-sensitive skin that is irritated by soft materials, and is soothed by rougher materials. Therefore, various example embodiments of the present general inventive concept may provide rough surface materials such as, for example, terrycloth or other material with such disparate contiguous surfaces, in areas of a swaddling garment that may come in contact with the baby's skin, while providing softer and more tactilely pleasing materials in portions of the swaddling garment that are contacted by a caretaker holding, or "cuddling," the baby. Various example embodiments of the present general inventive concept may provide more secure arrangements for holding the infant, such as a pocket shape and/or body harness, and may provide an access port through which tubes, wires, and other various medical connections may pass without compromising the security and integrity of both the wraps and the medical connections. Various example embodiments may provide padding to comfort and maintain the position of the baby, as well as padding to aid in the comfort of the caretaker during cuddling of the swaddled infant. As the feeling of being held securely by human arms aids tremendously in the general well-being of infants, various example embodiments of the present general inventive concept may provide securing straps that are oriented and formed to provide the illusion of being held tightly by human arms. Various example embodiments of the present general inventive concept may provide a receiving area such as a pocket to hold a device such as a white noise machine, which has been shown to aid in comforting these distressed infants. Many various example embodiments of the present general inventive concept may provide one or more of these features, as well as other features which will be described herein. In the descriptions of these embodiments, terms such as swaddler, swaddling garments, swaddling wrap, infant wrap, infant cuddler, cuddler, etc., may be used interchangeably.

FIG. 1 illustrates a swaddling wrap according to an example embodiment of the present general inventive concept. It is understood that various embodiments of the present general inventive concept may contain more or fewer features than those illustrated in the embodiment of FIG. 1, and/or may be arranged in a variety of configurations. The features of the present general inventive concept are not limited to any particular illustration and/or described embodiment discussed herein. As illustrated in FIG. 1, a swaddling wrap 100 for swaddling an infant according to this example embodiment includes a base layer 102 that forms a bottom of the swaddling wrap 100 that the infant will be placed over. This base layer 102 is constructed such that a front surface, i.e., the surface of the base layer which will face the infant when the infant is placed inside the swaddling wrap 100 in the normal configuration, is covered with a rough texture such as that provided by, for example, terrycloth. Rougher textures such as these have been shown to be tactilely soothing to the skin of infants suffering from NAS. Rough materials other than terrycloth may be utilized in various example embodiments of the present general inventive concept. The rear surface of the base layer 102 is provided with a soft texture relative to the rough texture of the front surface. This soft texture may be provided through use of a variety of materials such as linen, faux fur, microfiber, etc., which may be more tactilely pleasing to a caretaker that cuddling the infant in the swaddling wrap 100, which also encourages the caretaker to spend more time holding the swaddled infant. In various example embodiments, the material forming the soft rear surface, which is merely softer relative to the rough front surface, may partially wrap around one or more edges of the front surface of the base layer 102, but the vast majority of the front surface will be covered with the rough material so that any contact with the infant will be through the rough surface.

The swaddling wrap 100 includes a body padding portion 112 to provide a secure area in which the infant may rest in the swaddling wrap 100. In various example embodiments the front surface of the body padding portion 112 will be provided with a rough surface which may be similar to, or the same as, the surface of the base layer 102. In other example embodiments the body padding portion 112 will be covered completely in the rough surface to ensure that all portions of the body padding portion 112 that may contact the infant will be covered with the rough surface. The body padding portion 112 illustrated in FIG. 1 includes a padded head support roll 114 that is formed to substantially surround the top and sides of the infant's head, providing comfortable support and serving to align the infant's head in an "upward" facing orientation. In various example embodiments, the head support roll 114 may also have padding positioned to be under the infant's head. Various example embodiments of the present general inventive concept provide the head support roll 114 in a substantially u-shape, which may flare out slightly at respective distal ends as the head support roll 114 approaches a shoulder area. The body padding portion 112 of FIG. 1 includes a padded leg support roll 116 arranged to be transverse to the length of the body padding portion 112 and positioned so that an infant's legs may be supported by the leg support roll 116 behind the knee. A more pliant portion 118 is provided between the head support roll 114 and the leg support roll 116 so that an overall distance between the head support roll 114 and the leg support roll 116 can be altered according to the infant's needs. For example, in various example embodiments the pliant portion 118 may not be provided with padding, so that it may be easily folded, bunched, etc., to decrease the overall length of the body padding portion 112. The body padding portion 112 is also provided with a body harness 120 to secure the infant into the body padding portion 112. The body harness 120 includes a Y-shaped strap configuration formed so that a strap may be placed over each shoulder, and run through the legs, the length of the straps being adjustable to fit different shapes of infants. Various example embodiments of the present general inventive concept may provide a body padding portion 112 with differently arranged padding, without a body harness, with a detachable body harness, and so on. Various example embodiments may provide a body padding portion 112 that is readily detachable from, i.e., detachably fastened to, the swaddling wrap 100. By being readily detachable from the swaddling wrap 100, i.e., by being designed to be easily separated without any structural damage or excessive manipulation, the body padding portion 112 may be easily removed for cleaning, and may be provided in various alternate sizes for different infants to be accommodated in the swaddling wrap 100. In some example embodiments, the body padding portion 112 may be eliminated altogether for various reasons, such as larger infants that may not need such an accommodation. In the example embodiment illustrated in FIG. 1, the body padding portion 112 is shown in a detached state from the swaddling wrap 100, and is attachable to the swaddling wrap by way of fastening member 121 positioned on the base layer 102, a mating member of which is provided on a back of the body padding portion 112. In various example embodiments, the fastening member 121 may include one or more hook and loop fasteners, buttons, snaps, zippers, and so on.

The example embodiment of the swaddling wrap 100 illustrated in FIG. 1 includes a pocket forming layer 104 that is attached to the base layer 102 and designed to form a pocket with the base layer 102 in which at least a portion of the infant will rest when placed inside the swaddling wrap 100. In the example embodiment illustrated in FIG. 1, the pocket forming layer 104 is attached at a bottom and along one side of the base layer 102, and is detachably fastened to the other side of the base layer 102. As with other detachably fastened portions of the swaddling wrap 100, the fastening portion 106 of the pocket forming layer may include one or more hook and loop fasteners, buttons, snaps, zippers, and so on. By being readily openable on one side, the convenience of the caretaker placing the infant inside the swaddling wrap 100 may be increased. As can be seen in FIG. 1, with the pocket forming layer 104 unfastened and folded over, the caretaker can more easily access the base layer 102 and body padding portion 112 to secure the infant therein. After securing the infant inside, the pocket forming layer 104 may be closed and fastened to form a pocket to enhance comfort, and to provide a more secure arrangement, for the infant. The pocket forming layer 104 of this example embodiment is provided with a rough texture at least on the surface that is facing the infant, and may be formed with the same material as the rough surface of the base layer 102. The outwardly facing surface of the pocket forming layer 104 may be provided with a soft texture to increase the aesthetics and comfort to the caretaker. In various example embodiments, the pocket forming layer 104 may be detachable on more than one side, or may be completely detachable from the base layer 102. A wire port 108 is provided near a bottom of the pocket so that monitoring wires such as EKG wires leading from electrodes affixed to the infant's skin, or other devices such as IV tubes inserted into the infant, may pass therethrough without causing discomfort to the infant or interrupting the swaddling portions of the swaddling wrap 100. Rather than having such wires and/or tubes being pulled in an upward direction out of the pocket formed by the pocket forming layer 104, or otherwise interrupting the wrapping structures, the wires are easily run through the wire port 108 to be connected to corresponding medical equipment, thus increasing the convenience of the caretaker as well as the comfort of the infant swaddled therein. In the example embodiment of FIG. 1, the wire port 108 is provided at a bottom corner of the pocket forming layer 104 just below a point where the fastening portion 106 terminates, but various other example embodiments may provide such a port at different points or in different configurations. For example, in various example embodiments the wire port 108 may be formed as an slit or similar opening away from the detachable portion of the pocket forming layer 104, or may be provided in the base layer 102 to go out the bottom or back side thereof, and so on.

The swaddling wrap 100 includes a padded head cushion 122 attached to the top of the base layer 102. The head cushion 122 extends away from the base layer 102 to provide pillowed support for the head support roll 114 of the body padding portion 114. In the example embodiment illustrated in FIG. 1, a depressed portion 124 is formed in the front of the head cushion 122 for the back of the head support roll 114 to rest therein, thereby providing more comfort and security by inhibiting lateral and up and down movement of the head support roll 114. In such an example embodiment, the body padding portion 112 may be configured such that the head support roll 114 extends from the top portion of the base layer 102 so as to be freely received in the depressed portion 124 of the head cushion 122. As the head support roll 114 rests freely in the depressed portion 124 of the head cushion 122, a caretaker may place a hand or arm or other article in between the head support roll 114 and the head cushion 122 for various purposes such as cradling the infant's head, adding additional padding or washable materials, and so on.

A device pocket 126 is provided at the side of the head cushion to hold an electronic device such as a white noise machine, which has been shown to provide comfort to infants suffering from NAS. While the device pocket 126 is formed as an inner pocket in the head cushion 122 of this example embodiment, in other various example embodiments different device holding compartments may be provided, such as an external holder or pocket, or the like. By placing the device holding compartment at the side of the head cushion 122, the distance to the infant's ears is minimized such that lower volume is required to smooth the infant, which makes it easier for the caretaker to communicate with others while holding the infant in the swaddling wrap 100.

A flap 110 extends from one side of the base layer 102, and is formed so as to be foldable over the infant to produce a swaddling effect. In various example embodiments, the flap 100 simply continues outward from the base layer 102 and has the same rough textured surface on the side that will face the infant when the flap 110 is closed, and the same soft texture material on the opposite side, i.e., the side that will face upward and away from the infant when the flap 110 is closed. The flap 110 is formed so as to fold over the pocket forming layer 104 to perform the swaddling action. A pair of securing straps 128 are provided to the swaddling wrap 100 to wrap around the flap 110 and secure it in a closed position. The securing straps 128 are respectively attached at opposite sides of the base layer 102, and each have a proximal end attached to the base layer 102 and a distal end used in the folding procedure. In the example embodiment illustrated in FIG. 1, the securing straps 128 are formed to resemble arms that wrap around the front of the swaddling wrap. In various example embodiments of the present general inventive concept, the securing straps 128 are formed in a substantially tubular shape filled with padding, and are configured to fold together so as to resemble crossed arms of a caretaker, to provide the infant with the feeling of being held snugly by human arms. In various example embodiments, the securing straps 128 may be provided with additional securing members to maintain the closed formation. In various example embodiments, the distal ends of the straps 128 may be provided with thumb-like protrusions to abut against the "arms" to both provide a more secure wrapping/folding of the arms, and to also increase the anthropomorphic illusion of the straps 128 as arms. In the example embodiment illustrated in FIG. 1, the flap 110 is attached to the adjacent strap 128 near a distal point on the strap 128. Such an attachment may provide more convenience to the caretaker by allowing the flap 110 and attached strap 128 to be folded over the swaddling wrap 100 at the same time, keeping the attached strap 128 in place while folding the other strap 128 around/through, and helping to keep the flap 110 closed while the straps 128 are in the wrapped position. In various example embodiments of the present general inventive concept, the flap 110 and attached strap 128 may be detachably fastened together by any of a host of known fastening members such as those already discussed herein. In various example embodiments, both securing straps 128 may be detachably fastened to the flap 110 when the flap 110 is closed over the swaddling wrap 100.

In the example embodiment illustrated in FIG. 1, a length of padding referred to herein as a padded side rail 129 is provide along one side of the swaddling wrap 100 to provide extra padding and to also aid in maintaining the overall shape of the swaddling wrap 100. In various example embodiments, the padding of the padded side rail 129 is more rigid than the base layer 102, and therefore provides support to aid in maintaining at least a length of the swaddling wrap 100. In various example embodiments of the present general inventive concept, such a padded side rail 129 may be provided along both sides of the swaddling wrap 100. Such added support may aid in maintaining the overall predetermined dimensions of the swaddling wrap 100, which may be configured to be placed in a conventional NICU bassinet and fit snugly therein, so that the baby feels swaddling comfort even when not held by a caretaker, and is prevented from thrashing around, turning over onto the side or stomach, and so forth. Along with aiding in maintaining the overall shape, the padded side rail or rails may also provide padding between the infant and the relatively hard sides of the NICU bassinet.

Various example embodiments of the present general inventive concept may include one or more bottom extensions 130 extending from a bottom of the base layer 102 and configured to be tucked under the folded arrangement of the securing straps 128 such that the swaddling wrap 100 may be shortened to a desired length. In the example embodiment illustrated in FIG. 1, the swaddling wrap 100 is formed so as to have at least somewhat exaggerated anthropomorphic animal characteristics to provide an attractive aesthetic appearance for the swaddling wrap. For example, the bottom extensions 130 are formed as anthropomorphic feet, the securing straps 128 are formed in the shape of arms, and the padded head cushion 122 is provided with ear portions 132 extending form the top thereof. Various other anthropomorphic features may be provided to various example embodiments of the swaddling wrap 100 according to the present general inventive concept, such as light coloring provided to the flap 110 and/or pocket forming layer 104 and/or depressed portion 124 so as to resemble different portions of the animal portrayed. Various example embodiments of the present general inventive concept may include a host of different anthropomorphic features/designs, or may not include any anthropomorphic features at all.

Figure 2:
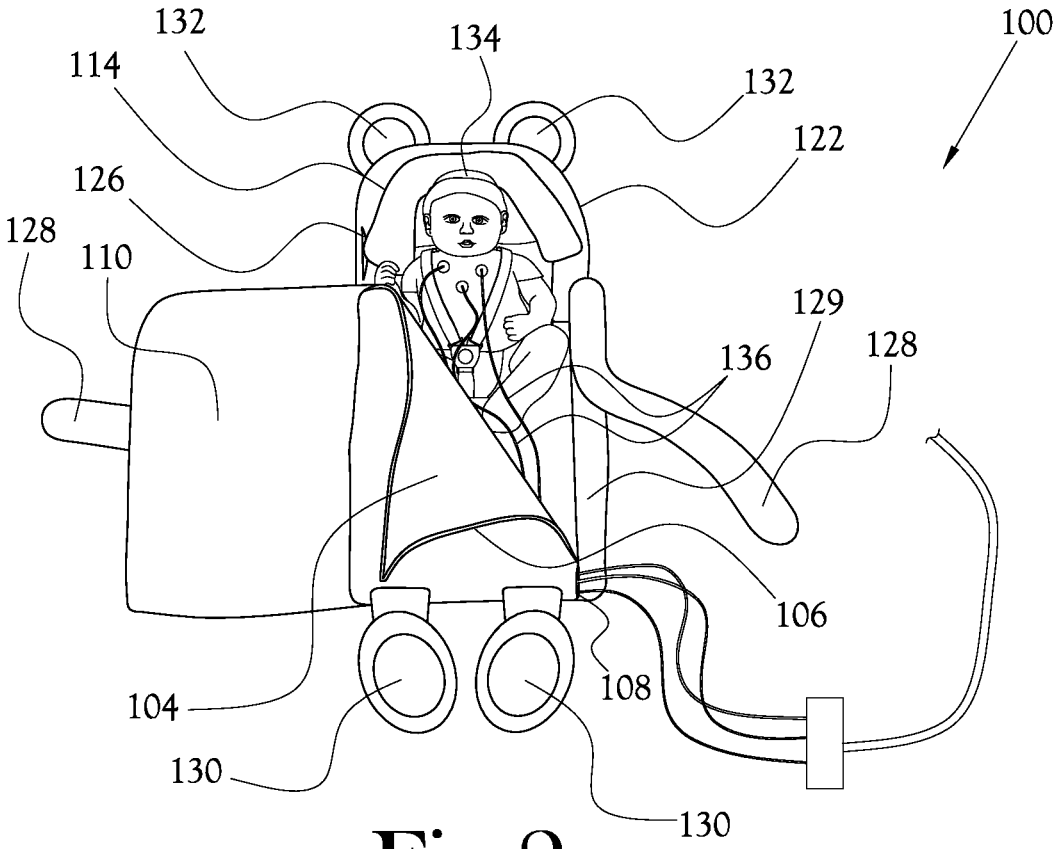
FIG. 2 illustrates the swaddling wrap of FIG. 1, after the body padding portion has been attached and an infant has secured therein, but before the pocket forming layer is closed.
Figure 3:
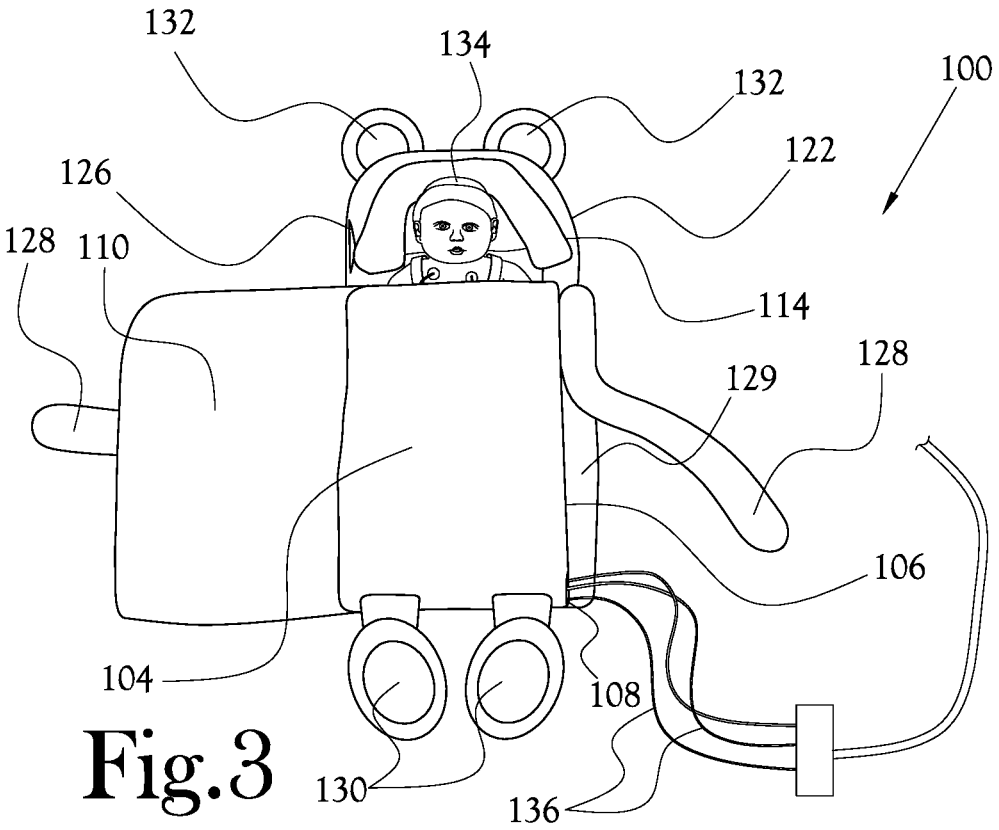
FIG. 3 illustrates the swaddling wrap of FIG. 2 with the pocket forming layer closed.
Figure 4:
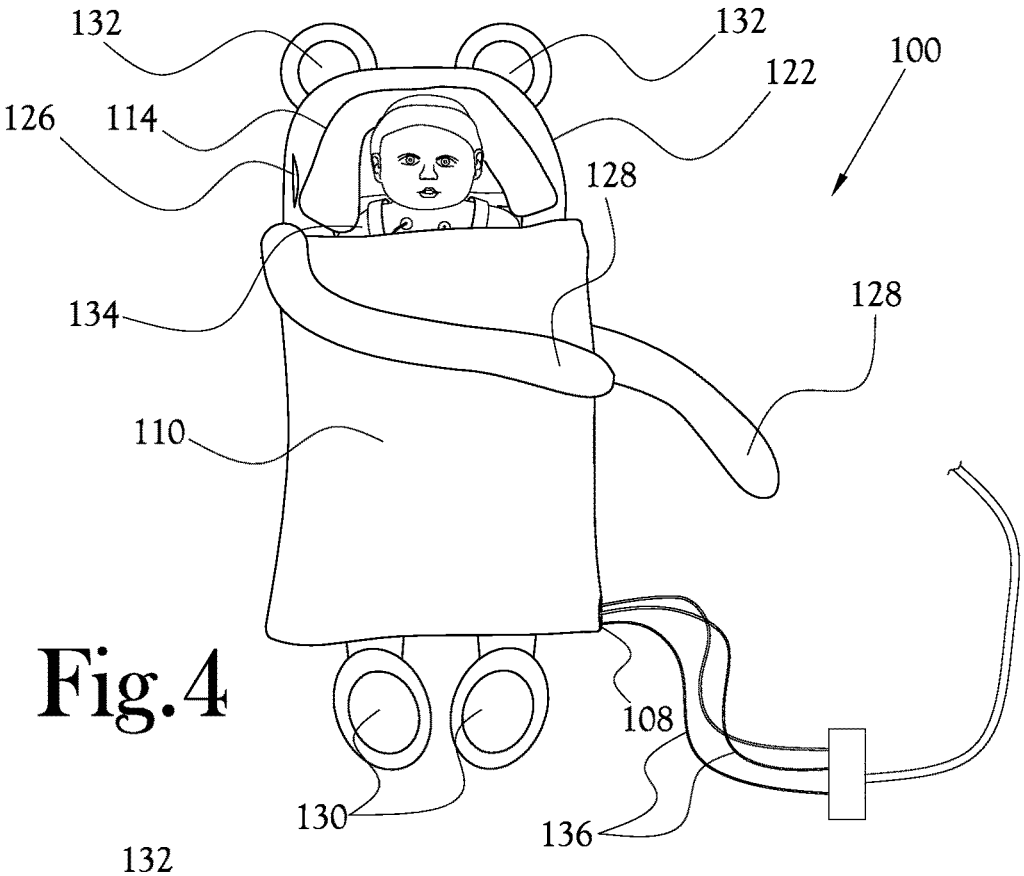
FIG. 4 illustrates the swaddling wrap of FIG. 3 with the flap closed.
Figure 5:
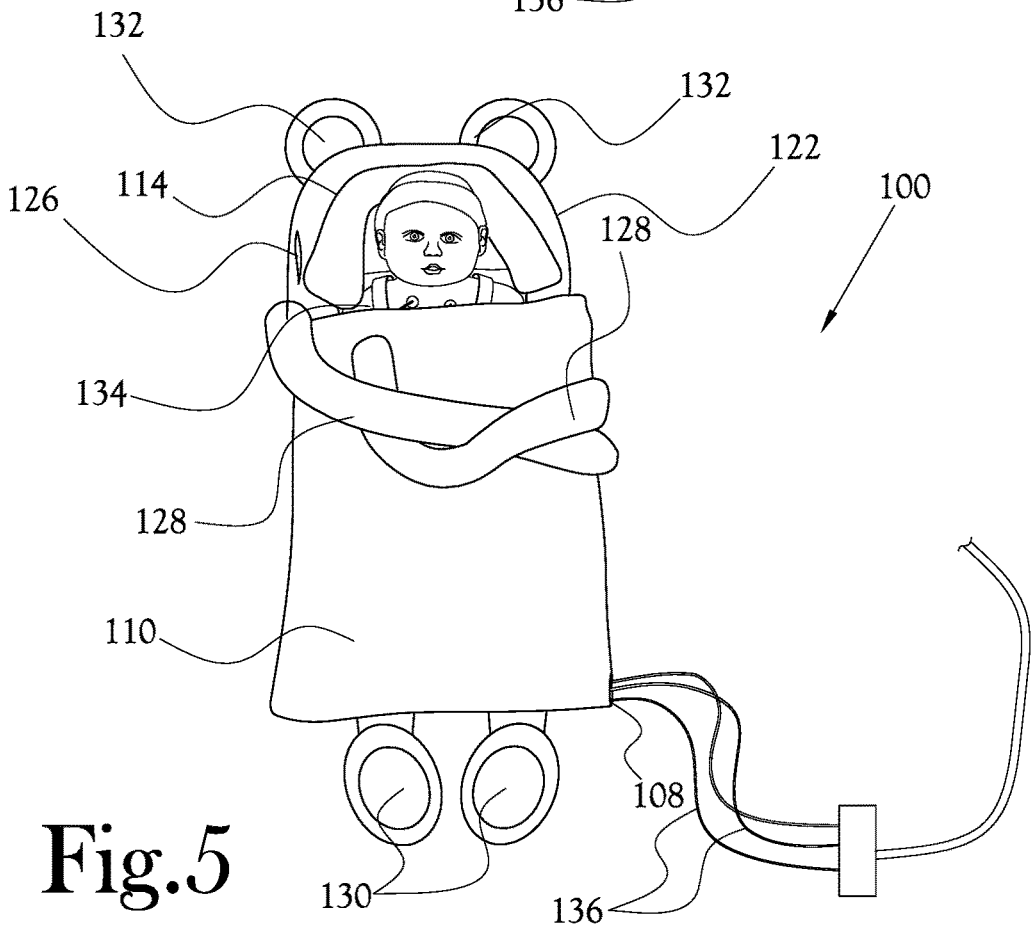
FIG. 5 illustrates the swaddling wrap of FIG. 4 with the securing straps folded together.

FIG. 2 illustrates the swaddling wrap 100 of FIG. 1, after the body padding portion 112 has been attached and an infant 134 has secured therein, but before the pocket forming layer 104 is closed. In FIG. 2, the body padding portion 112 has been attached to the swaddling wrap 100 and the infant 134 has been secured inside the body padding portion 112 by the body harness 120. As illustrated in FIG. 2, a host of medical connections such as monitor wires 136 are attached to electrodes affixed to the infant 134, and which are run through the wire port 108 to outside connections. FIG. 3 illustrates the swaddling wrap 100 of FIG. 2 with the pocket forming layer 104 closed. The pocket forming layer 104 has been placed over the infant 134, and the fastening portion 106 has been used to fasten the pocket forming layer 104 in place. FIG. 4 illustrates the swaddling wrap 100 of FIG. 3 with the flap 110 closed. In the example embodiment illustrated in FIG. 4, the securing strap 128 adjacent to the flap 110 is attached at a distal end thereof to the flap 110, and is therefore moved over the infant 134 along with the flap 110. FIG. 5 illustrates the swaddling wrap 100 of FIG. 4 with the securing straps 128 folded together. The securing strap 128 that is not attached to the flap 110 is folded under the other securing strap 128 to secure the wrap and to provide the sensation of folded arms snugly holding the infant 134. In the example embodiment illustrated in FIG. 5, the arms are offset from one another in an axial direction of the swaddling wrap 100 to aid in the folding procedure, but various other example embodiments may include a host of other configurations for the securing straps 128. Various example embodiments may provide detachable fasteners, such as hook and loop connections, snaps, buttons, etc., to hold the folded securing straps 128 in place. As illustrated in FIG. 5, a secure and comforting swaddling wrap 100 is provided to the infant 134, and passage for the monitoring wires 136 is provided for without interrupting the comfort of the infant and caretaker, and without disturbing the integrity of the wrapping layers.

Figure 6:
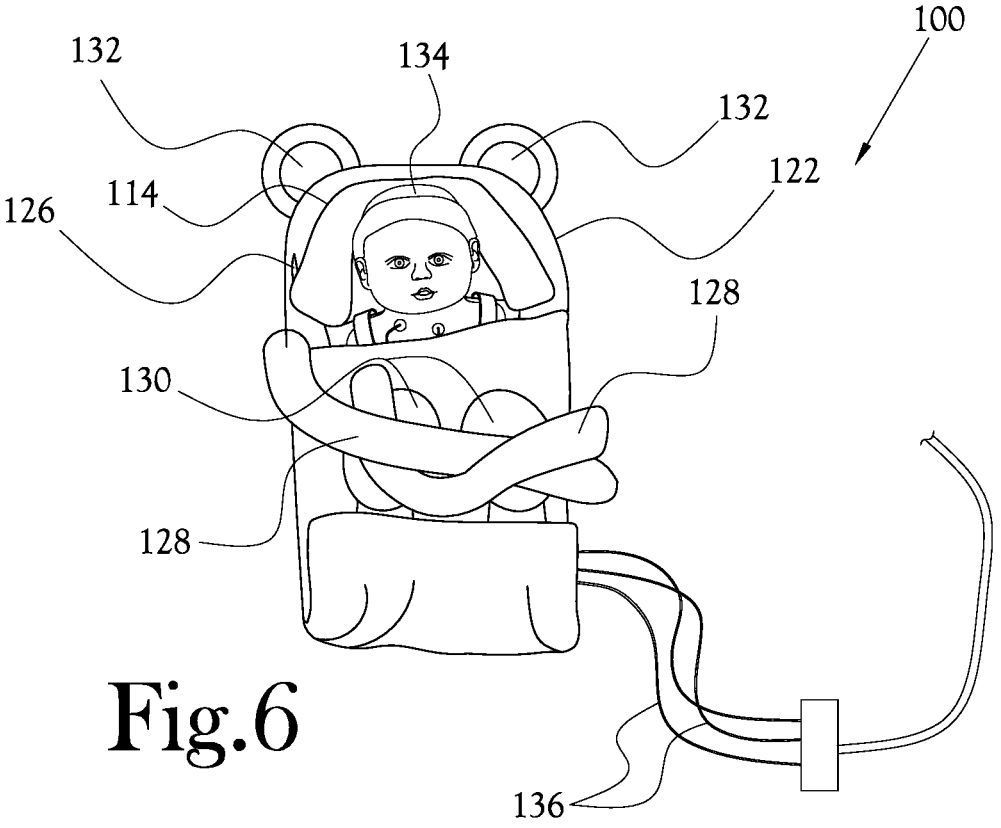
FIG. 6 illustrates the swaddling wrap of FIG. 5 in a folded state to shorten a length of the swaddling wrap.

FIG. 6 illustrates the swaddling wrap 100 of FIG. 5 in a folded state to shorten a length of the swaddling wrap 100. As the infant 134 is much shorter than the overall length of the swaddling wrap 100, the bottom extensions 130 may simply be pulled up and tucked under the securing straps 128 to easily shorten the length of the swaddling wrap 100 and provide an even more secure feeling to the infant and caretaker.

Figure 7:
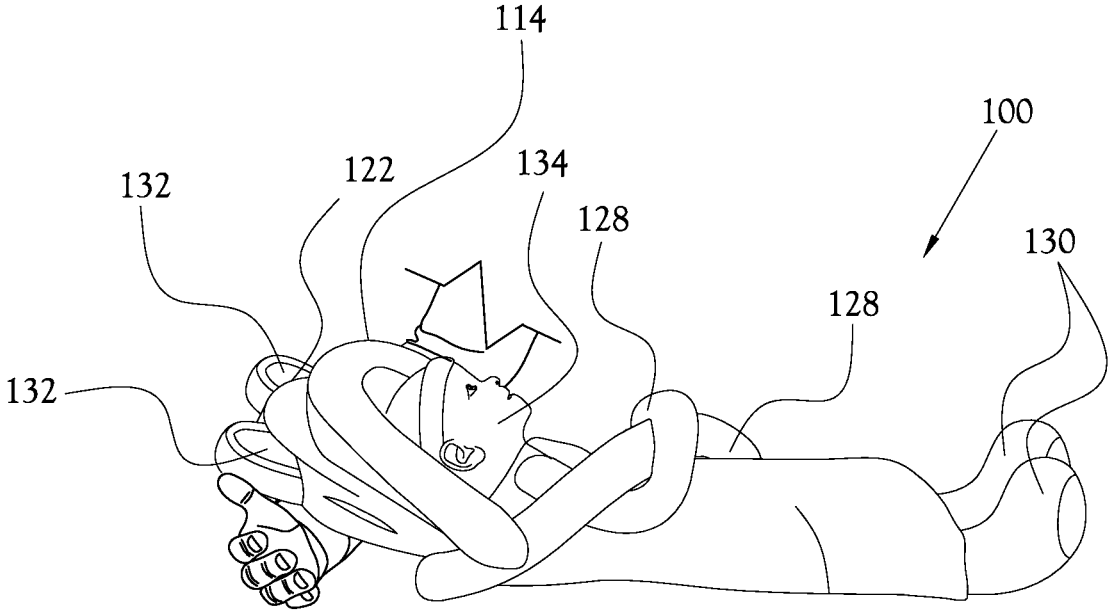
FIGS. 7-8 illustrate a side view of the swaddling wrap of FIG. 5.
Figure 8:
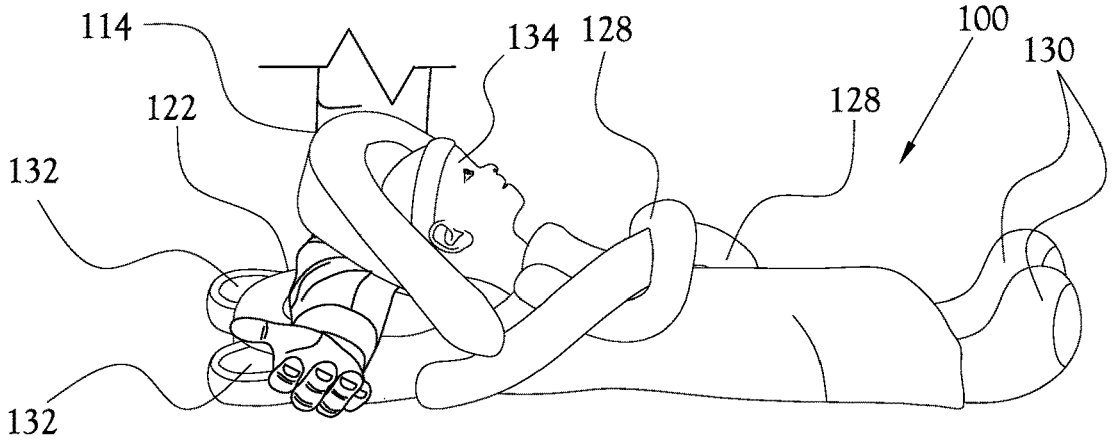

FIGS. 7-8 illustrate a side view of the swaddling wrap of FIG. 5. As illustrated in FIG. 7, when the infant 134 is secured and swaddled in the swaddling wrap 100, the caretaker may place a supporting arm under the head cushion 122 in a typical fashion. However, as illustrated in FIG. 8, because the portion of the body padding portion 112 proximate the infant's head simply rests in the depressed portion 124 of the head cushion 122, the head cushion 122 and adjacent portion of the body padding portion 112 may be pivoted away from one another to form a space therein. In the example embodiment illustrated in FIG. 8, the caretaker has placed his/her arm in the space created between the head cushion 122 and body padding portion 112 to cradle the infant's head on the arm of the caretaker, and to rest the caretaker's arm on the head cushion 122 to provide comfort for the caretaker in extended periods of cuddling. The space between the head cushion 122 and body padding portion 112 may also be used for additional articles such as extra padding, etc.

Figure 9:
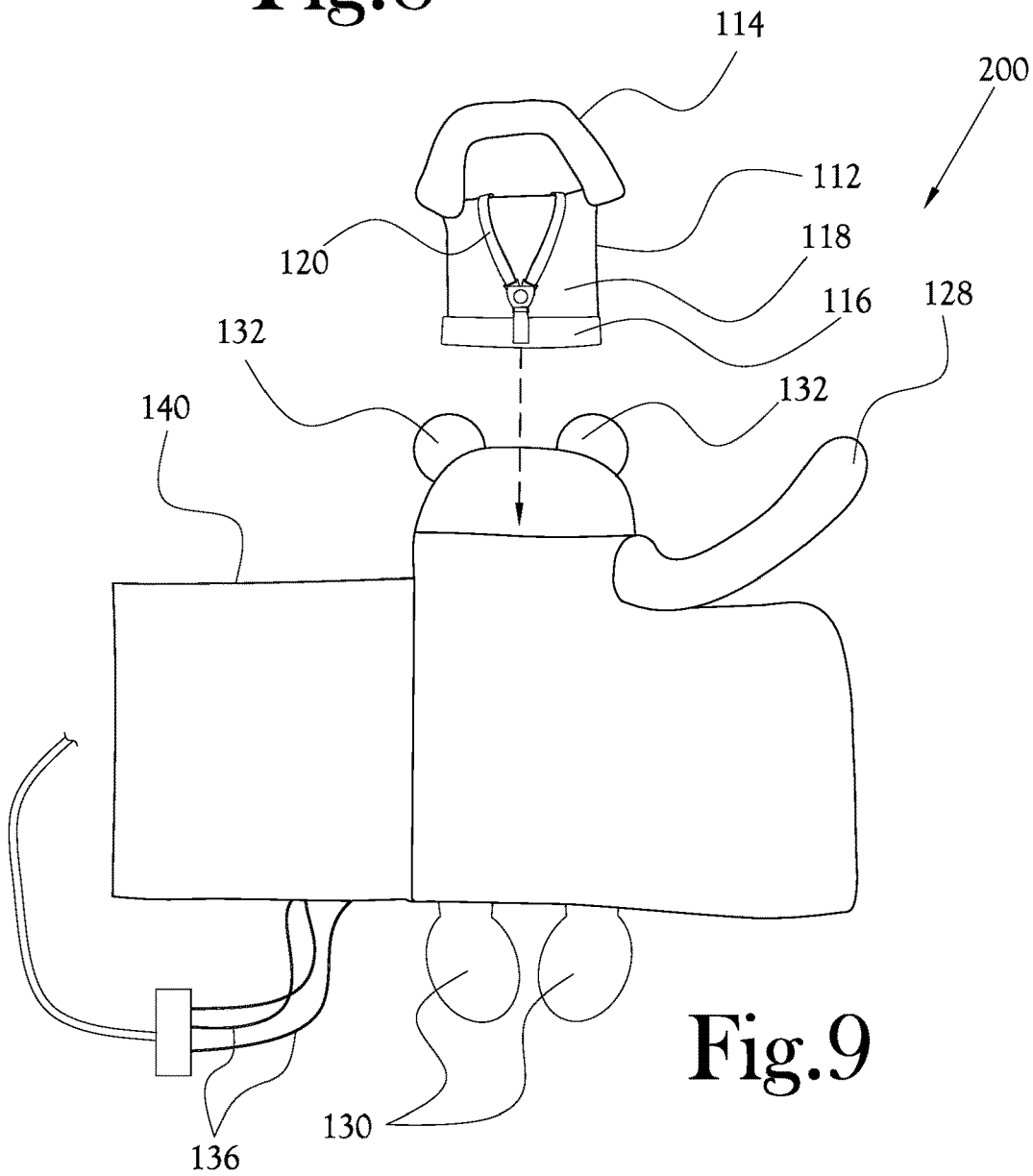
FIG. 9 illustrates a back view of a swaddling wrap according to another example embodiment of the present general inventive concept.

FIG. 9 illustrates a back view of a swaddling wrap according to another example embodiment of the present general inventive concept. In the example embodiment illustrated in FIG. 9, the swaddling wrap 200 has been provided with an extra flap 120 provided on an opposite side of the swaddling wrap 200 than the previously described flap 110, and the body padding portion 112 has been detached from the front of the base layer 102 to be placed on a back side of the swaddling wrap 200. In still other example embodiments of the present general inventive concept, the body padding portion 112 may be omitted from the wrap altogether. Therefore, the swaddling wrap 200 is "reversible", and the infant may placed on the back surface of the swaddling wrap 200 to be swaddled. In various example embodiments of the present general inventive concept, after the infant has been placed in the body padding portion 112 and placed on the back surface of the swaddling wrap 200, at least the extra wrap 140 may be wrapped over the infant to provide a swaddling arrangement. The flap 110, in example embodiments in which the flap 110 is not attached to the securing member 128, or is detachably fastened thereto, may also be folded over the infant to provide more swaddling layers. The securing members 128 may be wrapped around the back side of the swaddling wrap 200 in a similar fashion to how they are deployed in the front of the swaddling wrap 100 of the previous figures. While the infant may not be in contact with as much roughly textured surface in this reversed arrangement, especially when not secured in the body padding portion 112, such an arrangement may be desirable for situations such as, for example, when infants are too large for the front arrangement previously described, or when the front compartments have become soiled no other swaddling wraps are available, or simply for the relative convenience of the arrangement.

Various example embodiments of the present general inventive concept may provide an infant wrap for swaddling an infant, including a base layer configured with a front surface having a rough texture and a rear surface having a soft texture relative to the rough texture, a pocket forming layer attached to the base layer and configured to form a pocket with the base layer, the pocket forming layer having the rough texture at least on an inner surface facing the base layer, and configured to be detachably fastened to the base layer on at least one side of the pocket forming layer, a wire port formed proximate a bottom of the pocket forming layer and configured such that monitor wires are able to pass therethrough, and a flap extending from one side of the base layer and having a same textured and soft surface arrangement as the base layer, and configured to fold over the pocket forming layer such that the surface of the flap having the rough texture faces inwardly toward the pocket forming layer. One or more surfaces having the rough texture may be formed with terrycloth. One or more surfaces having the soft texture may be formed with faux fur, linen, microfiber, or fleece. The infant wrap may further include a body padding portion detachably fastened to the base layer and having the rough texture at least on a front surface and configured to have a substantially u-shaped head support roll at a top thereof configured to provide padded support proximate a top and sides of an infant's head, a transverse leg support roll proximate a bottom thereof configured to provide padded support under an infant's legs, and a pliant portion between the head support roll and leg support roll to allow distance therebetween to be adjustable. The pocket may be formed by the pocket forming layer surrounds at least a portion of the body padding portion. The body padding portion may further include a body harness configured to secure an infant into the body padding portion. The infant wrap may further include a padded head cushion extending from a top portion of the base layer and having a depressed portion on a front surface thereof, and a device compartment formed proximate a side of the head cushion configured to hold a white noise producing device. The body padding portion may be configured such that the head support roll extends from the top portion of the base layer to be freely received in the depressed portion of the head cushion. The infant wrap may further include a pair of securing straps extending respectively from opposite sides of the base layer and configured to be wrapped over the flap in a folded arrangement to secure the infant wrap in a swaddling form. The securing straps may be padded and formed in a substantially tubular shape so as to approximate a shape of human arms. A securing strap extending from a same side of the base layer as the flap may be attached to the flap at a point proximate a distal end of the securing strap and proximate a distal side of the flap. The infant wrap may further include one or more bottom extensions extending from a bottom of the base layer and configured to be tucked under the folded arrangement of the securing straps such that a length of the infant wrap may be shortened to a desired length. The wire port may be provided proximate a bottom corner of the pocket formed by the pocket forming layer, and adjacent to a fastening member configured to detachably fasten the at least one side of the pocket forming layer to the base layer. The fastening member may be a zipper, one or more hook and loop attachment portions, one or more snaps, or one or more buttons.

Various example embodiments of the present general inventive concept may provide an infant wrap for swaddling an infant, including a base layer configured to be positioned at least partially under an infant in a swaddling configuration, a padded head cushion extending from a top portion of the base layer and having a depressed portion on a front surface thereof, a body padding portion detachably fastened to the base layer and configured to have a substantially u-shaped head support roll at a top thereof configured to provide padded support proximate a top and sides of an infant's head, and a transverse leg support roll proximate a bottom thereof configured to provide padded support under an infant's legs, and at least one flap extending from one side of the base layer and configured to fold over and surround at least the body padding portion of the infant wrap, wherein the body padding portion is configured such that the head support roll extends from the top portion of the base layer to be freely received in the depressed portion of the head cushion. At least one of the padded head cushion and head support roll may be configured to be selectively pivoted away from the other to provide room for a separate support body. The body padding portion may further include a body harness configured to secure an infant into the body padding portion, the body harness configured in a y-formation to provide a strap over each shoulder of the infant and a strap between the legs of the infant. The infant wrap may further include a padded support rail provided along at least one side of the base layer and configured to be more rigid than the base layer to support an overall shape of the infant wrap.

Various example embodiments of the present general inventive concept may provide an infant wrap for swaddling an infant, including a base layer configured with a front surface having a rough texture and a rear surface having a soft texture relative to the rough texture, a padded head cushion extending from a top portion of the base layer and having a depressed portion on a front surface thereof, a device compartment formed proximate a side of the head cushion, a body padding portion detachably fastened to the base layer and having the rough texture at least on a front surface and configured to have a substantially u-shaped head support roll at a top thereof configured to provide padded support proximate a top and sides of an infant's head, a transverse leg support roll proximate a bottom thereof configured to provide padded support under an infant's legs, a pliant portion between the head support roll and leg support roll to allow distance therebetween to be adjustable, and a body harness configured to secure an infant into the body padding portion, a pocket forming layer attached to the base layer and configured to form a pocket with the base layer that surrounds at least a portion of the body padding portion, the pocket forming layer having the rough texture at least on an inner surface facing the base layer, and configured to be detachably fastened to the base layer on at least one side of the pocket forming layer, a wire port formed proximate a bottom of the pocket forming layer and configured such that monitor wires are able to pass therethrough, a flap extending from one side of the base layer and having a same textured and soft surface arrangement as the base layer, and configured to fold over the pocket forming layer such that the surface of the flap having the rough texture faces inwardly toward the pocket forming layer, a pair of securing straps extending respectively from opposite sides of the base layer and configured to be wrapped over the flap in a folded arrangement to secure the infant wrap in a swaddling form, the securing straps being padded and formed in a substantially tubular shape, one or more bottom extensions extending from a bottom of the base layer and configured to be tucked under the folded arrangement of the securing straps such that a length of the infant wrap may be shortened to a desired length, wherein the body padding portion is configured such that the head support roll extends from the top portion of the base layer to be freely received in the depressed portion of the head cushion. The infant wrap may be formed in a shape of an anthropomorphic animal such that the one or more bottom extensions are formed as feet, the securing straps are formed as arms, and the padded head cushion includes ear formed member extending from a top thereof.

Numerous variations, modifications, and additional embodiments are possible, and accordingly, all such variations, modifications, and embodiments are to be regarded as being within the spirit and scope of the present general inventive concept. For example, regardless of the content of any portion of this application, unless clearly specified to the contrary, there is no requirement for the inclusion in any claim herein or of any application claiming priority hereto of any particular described or illustrated activity or element, any particular sequence of such activities, or any particular interrelationship of such elements. Moreover, any activity can be repeated, any activity can be performed by multiple entities, and/or any element can be duplicated.

It is noted that the simplified diagrams and drawings included in the present application do not illustrate all the various connections and assemblies of the various components, however, those skilled in the art will understand how to implement such connections and assemblies, based on the illustrated components, figures, and descriptions provided herein, using sound engineering judgment. Numerous variations, modification, and additional embodiments are possible, and, accordingly, all such variations, modifications, and embodiments are to be regarded as being within the spirit and scope of the present general inventive concept.

While the present general inventive concept has been illustrated by description of several example embodiments, and while the illustrative embodiments have been described in detail, it is not the intention of the applicant to restrict or in any way limit the scope of the general inventive concept to such descriptions and illustrations. Instead, the descriptions, drawings, and claims herein are to be regarded as illustrative in nature, and not as restrictive, and additional embodiments will readily appear to those skilled in the art upon reading the above description and drawings. Additional modifications will readily appear to those skilled in the art. Accordingly, departures may be made from such details without departing from the spirit or scope of applicant's general inventive concept.

The invention claimed is:

1. An infant wrap for swaddling an infant, comprising:

a base layer configured with a front surface having a rough texture and a rear surface having a soft texture relative to the rough texture;

a pocket forming layer attached to the base layer and configured to form a pocket with the base layer, the pocket forming layer having the rough texture at least on an inner surface facing the base layer, and configured to be detachably fastened to the base layer on at least one side of the pocket forming layer;

a wire port formed proximate a bottom of the pocket forming layer and configured such that monitor wires are able to pass therethrough;

a flap extending from one side of the base layer and having a same textured and soft surface arrangement as the base layer, and configured to fold over the pocket forming layer such that the surface of the flap having the rough texture faces inwardly toward the pocket forming layer a pair of securing straps extending respectively from opposite sides of the base layer and configured to be wrapped over the flap in a folded arrangement to secure the infant wrap in a swaddling form; and one or more bottom extensions extending from a bottom of the base layer and configured to be tucked under the folded arrangement of the securing straps such that a length of the infant wrap may be shortened to a desired length.

2. The infant wrap of claim 1, wherein one or more surfaces having the rough texture are formed with terrycloth.

3. The infant wrap of claim 1, wherein one or more surfaces having the soft texture are formed with faux fur, linen, microfiber, or fleece.

4. The infant wrap of claim 1, further comprising:

a body padding portion detachably fastened to the base layer and having the rough texture at least on a front surface and configured to have a substantially u-shaped head support roll at a top thereof configured to provide padded support proximate a top and sides of an infant's head, a transverse leg support roll proximate a bottom thereof configured to provide padded support under an infant's legs, and a pliant portion between the head support roll and leg support roll to allow distance therebetween to be adjustable.

5. The infant wrap of claim 4, wherein the pocket formed by the pocket forming layer surrounds at least a portion of the body padding portion.

6. The infant wrap of claim 4, wherein the body padding portion further includes a body harness configured to secure an infant into the body padding portion.

7. The infant wrap of claim 4, further comprising:

a padded head cushion extending from a top portion of the base layer and having a depressed portion on a front surface thereof; and a device compartment formed proximate a side of the head cushion configured to hold a white noise producing device.

8. The infant wrap of claim 7, wherein the body padding portion is configured such that the head support roll extends from the top portion of the base layer to be freely received in the depressed portion of the head cushion.

9. The infant wrap of claim 1, wherein the securing straps are padded and formed in a substantially tubular shape so as to approximate a shape of human arms.

10. The infant wrap of claim 1, wherein a securing strap extending from a same side of the base layer as the flap is attached to the flap at a point proximate a distal end of the securing strap and proximate a distal side of the flap.

11. The infant wrap of claim 1, wherein the wire port is provided proximate a bottom corner of the pocket formed by the pocket forming layer, and adjacent to a fastening member configured to detachably fasten the at least one side of the pocket forming layer to the base layer.

12. The infant wrap of claim 11, wherein the fastening member is a zipper, one or more hook and loop attachment portions, one or more snaps, or one or more buttons.

13. The infant wrap of claim 1, wherein the infant wrap is formed in a shape of an anthropomorphic animal such that the one or more bottom extensions are formed as feet, the securing straps are formed as arms, and the padded head cushion includes ear formed members extending from a top thereof.

14. An infant wrap for swaddling an infant, comprising:

a base layer configured with a front surface having a rough texture and a rear surface having a soft texture relative to the rough texture;

a pocket forming layer attached to the base layer and configured to form a pocket with the base layer, the pocket forming layer having the rough texture at least on an inner surface facing the base layer, and configured to be detachably fastened to the base layer on at least one side of the pocket forming layer;

a wire port formed proximate a bottom of the pocket forming layer and configured such that monitor wires are able to pass therethrough;

a flap extending from one side of the base layer and having a same textured and soft surface arrangement as the base layer, and configured to fold over the pocket forming layer such that the surface of the flap having the rough texture faces inwardly toward the pocket forming layer;

a body padding portion detachably fastened to the base layer and having the rough texture at least on a front surface and configured to have a substantially u-shaped head support roll at a top thereof configured to provide padded support proximate a top and sides of an infant's head, a transverse leg support roll proximate a bottom thereof configured to provide padded support under an infant's legs, and a pliant portion between the head support roll and leg support roll to allow distance therebetween to be adjustable;

a padded head cushion extending from a top portion of the base layer and having a depressed portion on a front surface thereof; and a device compartment formed proximate a side of the head cushion configured to hold a white noise producing device.

15. The infant wrap of claim 14, wherein the body padding portion is configured such that the head support roll extends from the top portion of the base layer to be freely received in the depressed portion of the head cushion.

16. An infant wrap for swaddling an infant, comprising:

a base layer configured with a front surface having a rough texture and a rear surface having a soft texture relative to the rough texture;

a pocket forming layer attached to the base layer and configured to form a pocket with the base layer, the pocket forming layer having the rough texture at least on an inner surface facing the base layer, and configured to be detachably fastened to the base layer on at least one side of the pocket forming layer;

a wire port formed proximate a bottom of the pocket forming layer and configured such that monitor wires are able to pass therethrough;

a flap extending from one side of the base layer and having a same textured and soft surface arrangement as the base layer, and configured to fold over the pocket forming layer such that the surface of the flap having the rough texture faces inwardly toward the pocket forming layer;

a padded head cushion extending from a top portion of the base layer and having a depressed portion on a front surface thereof; and a device compartment formed proximate a side of the head cushion configured to hold a white noise producing device.

* * * * *